posed while the information on other index cards is underexposed partially or totally obscured. Thus the sight space 77 is a normal or desired distance whereas the sight space 81 is excessive and the sight space 79 is less than desired. The index card holders are moveable as explained and the condition illustrated in FIG. 2 can readily lead to the virtual disappearance of the sight space of one or more of the pocket cards in the index system.

DESCRIPTION OF THE INVENTION

The embodiment of the present invention illustrated in FIG. 4 includes a pocket card 10 mounted on a wire hanger indicated generally at 12 by conventional metal hinges 14. The wire hanger 12 is mounted in a holder, panel or tray 16 by flanges or turn-overs 18.

The pocket card or card holder 10 may have a plurality of card retaining slots or apertures 20 extending diagonally across the holder in the area adjacent each of the four corners. These slots are for the purpose of retaining cards or other information in sheet form and the slots 20 may extend at any desired angle such as about 45° relative to the top of the card holder. Each metal hinge 14 includes a barrel 22 at the top portion thereof for receiving the wire hanger 12. Each hinge also includes a pair of legs or prongs 24 which extend through the card holder 10 and are bent up adjacent the rear surface of the holder in a conventional manner.

The wire hanger 12 comprises a main body 26 which is straight or rectilinear in shape and terminates in reverse bent end portions indicated generally at 28. Referring to FIGS. 5 and 6 there is shown the left end of the hanger 12 of FIG. 4. Referring more particularly to FIG. 5 it is seen that the end of the main body 26 of the wire hanger 12 is bent with respect to the longitudinal axis of the main body to form the generally diagonal extending portion 30. From diagonal portion 30 the end of the wire hanger is reverse bent to form a loop indicated generally at 32.

The loop 32 comprises parallel spaced rectilinear portions or sides 34 and 36 connected by return 38. The rectilinear portions 34 and 36 are generally parallel and disposed substantially equal distances from the axis of the main body 26 of the wire hanger 12 on opposite sides thereof. The upper rectilinear portion 36 as seen in FIG. 5 is downwardly bent to form a diagonal leg indicated at 40. This diagonal leg 40 terminates in a hanger end 42 which overlies the main portion 26 of the hanger 12 as may best be seen in FIG. 6.

The loop 32 comprising rectilinear portions 34 and 36 and return 38 lie generally in the same plane. The diagonal leg 40 is bent upwardly as seen in FIG. 6 so that the end 42 extends parallel to the main body 26 in an overlying and slightly spaced fashion. The barrel 22 of the hinge 14 is mounted on the end 42 of the wire hanger 12. If desired a further hinge may be mounted along side the first on the end 42 of the wire hanger 12.

Referring to FIGS. 5 and 6 it will be seen that the wire hanger of the invention is generally symmetrical in plan view. As a result of the overlying relationship of the hanger ends to its main body portion the hanger does not lie in a single plane. The pivotal axis for the hinges is colinear with the ends 42 of the hanger which overlie the main body 26. When a series of hangers is disposed in parallel relationship in the usual fashion the main portions of the hangers lie substantially in a single plane. According to the invention the ends of the improved hangers lie in a different plane and establish hinge axes for the hinges in a second plane which is spaced from the plane of the main body portions of the hangers.

This arrangement provides free pivotal movement for the hinges regardless of whether the hanger 12 is mounted in the disposition shown in FIG. 4 or whether the hanger is reversed 180° from that position. In either event the axes of the end portions of the hangers which form the hinge axes lie substantially in a plane which is spaced above the plane of the main body portions of the hangers. The construction of the invention eliminates the above described problem encountered with erroneous mounting of conventional wire hangers in the holder or tray. While it is theoretically conceivable that one might attempt to mount the wire hanger with the ends 42 in a downward disposition as viewed in FIG. 6 it will be apparent that this is not possible as a practical matter. The invention thus virtually precludes improper mounting in a simple, economical and highly practical manner.

It will be understood that while a single wire hanger and pocket card are illustrated in the drawings herein a large multiplicity of such hangers and cards are customarily carried by a single frame or tray of a visible index system. Typical arrangements are illustrated by way of example in the Powell and Hopkins patents described hereinabove and commercial embodiments are presently marketed by Data Visible Corporation, P.O. Box 7767, Charlottesville, Va. 22906–7767 under the trademark "DAKAR."

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What I claim and desire to have secured by Letters Patent of the Unites States is:

1. The combination of a pocket card and a hanger for removably affixing said hanger to a pocket card support structure, said pocket card having hinges at opposite ends of one edge thereof and said hanger comprising: a substantially rectilinear main body portion extending along said one edge of said pocket card and an integral loop portion at each end of said main body portion, each said loop portion having a pair of spaced, substantially parallel sides with longitudinal axes which: lie in the same plane as the longitudinal axis of said main body portion, extend substantially parallel to the longitudinal axis of said main body portion, and are symmetrically disposed on opposite sides of said longitudinal axis of said main body portion, one of said sides of each said loop portion having a free end portion which extends along and substantially parallel to said axis of said main body portion and lies to one side of said main body portion, the longitudinal axes of the main body portion and the free end portions of said hanger being contained in a plane disposed at a right angle to the plane containing the longitudinal axes of said main body portion and the parallel sides of said loop portions, and said free end portions of the hanger extending through said hinges to thereby pivotably secure said pocket card to said hanger.

2. A wire hanger for pivotally supporting a pocket card of a visible index system from a card-supporting

VISIBLE INDEX SYSTEM WITH IMPROVED HANGER

This is a continuation of application Ser. No. 764,747, filed Aug 12, 1985, and now abandoned.

The present invention relates to visible index systems of the type on which data containing cards or pocket cards are removably mounted in pocket card holders disposed in overlapping relation on hangers which are removably assembled and mounted on a frame and more particularly relates to an improved hanger construction for removably mounting the pocket card holders in the frame.

BACKGROUND OF THE INVENTION

Typical visible index systems of the removable pocket card type are shown by way of example in U.S. Pat. No. 1,811,245 to Powell and U.S. Pat. No. 2,217,018 to Hopkins. In such systems a plurality of overlapping pocket card holders are supported by hinges from wire hangers carried in suitable frames. The frames are provided with spaced parallel flanges or turn-overs at the opposite sides thereof. The cards are hinged upon the wire hangers by means of hinges formed of metal which are fastened to the card.

Each hanger comprises a length of resilient wire having a straight main body portion with return ends bent to form a return portion which extends inwardly towards the main body portion for a limited distance. The bent end returns are axially offset relative to the axis of the main body of the hanger and terminate in off-set bent ends which lie adjacent and axially parallel to the main body portion. The hinges are mounted for pivotal movement on these ends.

The entire hanger lies substantially in a single plane which includes the main body portion, the returns, the off-set bent portions and the ends which lie adjacent and parallel to the main body portion. As seen from a top or plan view the hangers are asymmetrical with loops lying on one side of the axis of the main body portion. The hinge mounted pocket card holders may be easily removed from the tray without removing the hanger. However it is also desired that the hangers be readily insertable and removable to facilitate deletion or addition of cards and particularly to permit shifting of cards as for example to keep the cards is alphabetic or other order.

While pocket card mounting arrangements of the type illustrated in the Powell and Hopkins patents are generally acceptable and are in widespread commercial use they suffer from certain disadvantages. One such disadvantage is that the wire hanger is subject to insertion in the frame side channels or turn-overs in either of two positions. In the correct position the ends of the hanger lie above the main body and the hinges depend from these upper end portions of the hanger.

However, it is also possible to mount the wire hanger in the frame or tray in the opposite disposition wherein the hanger ends are disposed beneath the main body of the hanger. The hinges may be mounted on the hanger ends just as readily as in the former instance and the pocket card holder will pivot on the hanger. However, the main body and hinge axis spacing between adjacent hangers becomes random and varied with the result that irregular index spaces are provided. This tends to create index visibility problems. Because the index system is intended to be used and is used by a large number of persons who may not have frequent need of removing and inserting hangers it is relatively easy for hangers to be inserted in the undesired disposition thereby creating the undesired and troublesome mounting arrangement described above.

Other configurations of wire hangers of this general type are also disclosed in prior patents. Examples of illustrative variations are found in U.S. Pat. No. 1,153,520 to Rosenberger, U.S. Pat. No. 1,360,574 to Phillips, U.S. Pat. No. 1,574,893 to Hutchings, U.S. Pat. Nos. 2,298,290 and 2,246,584 to Hall and German Patent No. 458,524 to Blodner. The hanger constructions illustrated in these patents are generally asymmetrical and result in arrangements which do not preclude erroneous hanger insertion.

SUMMARY OF THE INVENTION

It is an object of this invention to provide an improved visible index system of the card or pocket card type wherein the pocket card holder is hingedly attached to a wire hanger which is insertable into a flanged or the like frame or tray in a reversible manner.

It is another object of the invention to provide an improved visible index system of the card or pocket card type wherein the pocket card holder is hingedly attached to a wire hanger which is insertable into a flanged or the like frame or tray in a reversible manner while maintaining a relatively uniform spacing between hinge axes of adjacent pocket card holders.

It is another object of this invention to provide an improved visible index system of the card or pocket card type wherein the pocket card holder is hingedly attached to a wire hanger which is insertable into a flanged or the like frame or tray in a reversible manner while maintaining relatively uniform index visibility spaces.

It is another object of the invention to provide an improved visible index system of the card or pocket card type wherein the pocket card holders are mounted in a flanged or the like tray using wire hangers which are generally symmetric in plan view and disposable in a reversible manner in such tray.

It is another object of the invention to provide an improved visible index system having pocket card holders hingedly attached to a flanged or the like tray through the use of wire hangers removably held by flanges or equivalent fastening means wherein such wire hangers are generally symmetrical in plan view but unsymmetrical in vertical elevation.

It is another object of the invention to provide an improved visible index system of the foregoing type wherein the hinging operation of each card holder is satisfactory without regard to the direction of insertion of an individual hanger or the direction of insertion of mutually adjacent hangers.

It is another object of the invention to provide an improved visible index system of the foregoing type wherein the visible index space for each card holder is satisfactorily maintained in a substantially uniform manner without regard to the direction of insertion of an individual hanger or the direction of insertion of mutually adjacent hangers.

It is another object of the invention to provide an improved wire hanger for a visible index system wherein the hanger has a body portion with reverse bent ends where each end includes a pair of spaced parallel rectilinear portions disposed on opposite sides of the longitudinal axis of the main body portion of the wire hanger and terminating in ends arranged in overlying relationship with the main body portion of the hanger.

It is a particular object of the present invention to provide a visible card index system comprising multiple planar card bodies or pocket card holders each having a pair of hinges attached to one edge and supported by a resilient wire hanger which has a rectilinear main body portion, with the multiple main body portions of the various hangers being disposed in spaced substantially parallel relationship, and with each hanger having reverse curved ends which include generally coplanar loop portions, each loop portion having a pair of spaced substantially parallel sides extending substantially parallel to the longitudinal axis of the main body portion of the hanger with such sides being disposed on opposite sides of the axis of the main body portion, one of the sides of each loop portion terminating in an end which extends substantially parallel to the axis of the main body portion adjacent to the main body portion above the plane of the coplanar loops, whereby each wire hanger is substantially symmetrical in shape when viewed perpendicular to the planes of the coplanar loops, and wherein the ends of the hangers extend through a pair of hinges attached to the top edge of a card holder to provide a pivotal mounting for the card.

It is still another object of the invention to provide a visible card index system of the foregoing type wherein the multiple wire hangers have their main body portions disposed substantially in a first plane and have their ends disposed substantially in a second plane spaced from the first plane whereby the card holders are pivoted about axes lying substantially in the second plane.

It is still another object of the invention to provide a visible card index system of the foregoing type which includes a mounting tray for holding the cards wherein the tray has spaced parallel channel means disposed perpendicular to the axes of the main body portions of the hangers and receives in such channel means the loop portions of the hangers.

These and further objects and advantages of the invention will become more apparent from reference to the following specification and claims and appended drawings wherein:

DESCRIPTION OF PRIOR ART PROBLEMS

Figure 1:
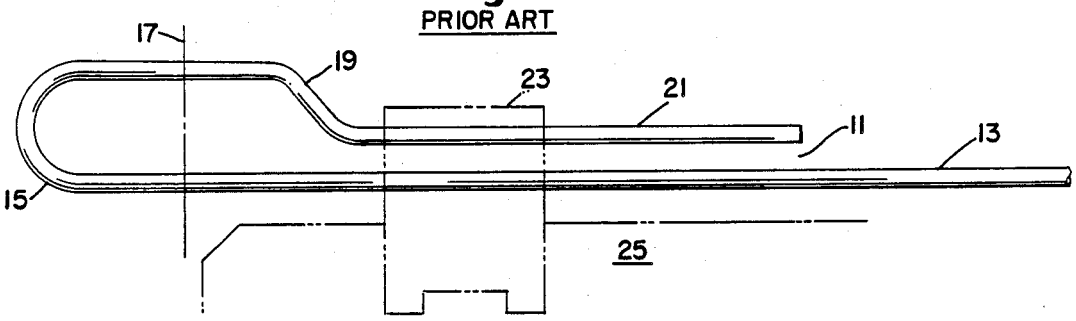
Fig.1 PRIOR ART
FIG. 1 is a partial plan view of a hanger constructed according to the prior art.

Referring to FIG. 1 there is shown a typical prior art wire hanger 11 of the type illustrated for example in U.S. Pat. No. 1,811,245 to Powell and U.S. Pat. No. 2,217,018 to Hopkins. The hanger comprises a length of resilient wire having a straight main body portion 13 terminating in a reverse curved end 15 which is held under a metal or plastic turn-over indicated in phantom at 17. The reverse curved end 15 is downwardly bent at 19 to terminate in a free end portion 21 parallel to the main body portion 13. A hinge shown in phantom at 23 is fastened over the end portion 21 and a pocket card holder shown in phantom at 25 depends from the hanger 11. The card holder 25 is hinged to the hanger on the axis of free end portion 21 of the hanger.

It is possible to remove the wire hanger 11 by flexing its central portion and lifting one or both of its ends from under the turn-overs 17 at opposite ends thereof. Once removed it is possible to reinsert the wire hanger in either of two positions. In the correct position illustrated in FIG. 1 the free end 21 is at the top of the main body portion 13 of the hanger. If the hanger is inserted in a reverse or opposite position the free end portion 21 is below the main body portion 13 and the hinge axis is moved from a position above the main body to below the main body.

Figure 2:
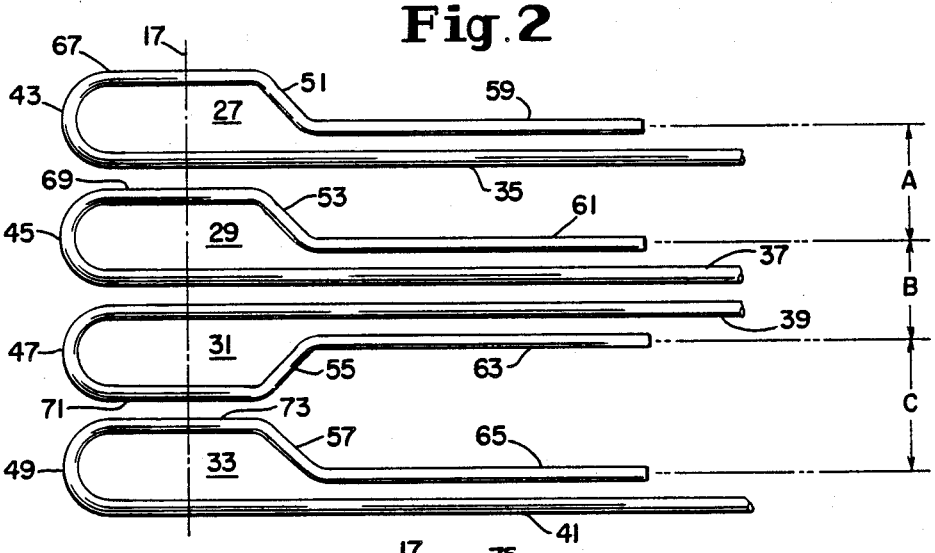
FIG. 2 is a partial plan view illustrating an effect of random insertion of prior art hangers.

Referring to FIG. 2 the effect of this reversal of the position of the hanger is shown. In that figure there are seen the ends of four hangers 27, 29, 31 and 33 having main body portions 35, 37, 39 and 41. The hangers have curved ends 43, 45, 47 and 49, bent portions 51, 53, 55 and 57 and free end portions 59, 61, 63 and 65.

The upper two hangers 27 and 29 and the lowermost hanger 33 are disposed in the conventional position with the free end portions 59, 61 and 65 above the main body portion. The third hanger 47 is disposed in the opposite direction with its free end portion 63 beneath the main body portion 39.

It will be understood that the wire hangers are slidable beneath the turn-overs 17 and that in a filled index system the return portions 67, 69, 71 and 73 of the reverse curved ends 43, 45, 47 and 49 will be in contact with the closest portion of adjacent hangers. FIG. 2 illustrates a condition wherein the index system is incompletely filled but wherein there is an equal spacing between adjacent portions of adjacent hangers.

The hinge axes formed by the free end portions 59, 61, 63 and 65 of the hangers 27, 29, 31 and 33 in FIG. 2 are illustrated by centerlines with the distance between adjacent centerlines indicated at A, B and C. The normal spacing is indicated at A between two properly positioned hangers 27 and 29 wherein the free end portions 59 and 61 are above the main body portions 35 and 37. The disposition of the third hanger 31 is reversed whereby its free end portion 63 lies below its main body portion 39. This creates a hinge axis spacing B which is less than the normal or desired hinge axis spacing A. The fourth hanger 33 is shown in the normal disposition with the free end portion 65 above the main body portion 41. However the position of the hanger 33 is reversed from that of the incorrectly disposed hanger 31 which creates a hinge axis spacing C greater than both spacings A and B.

Figure 3:
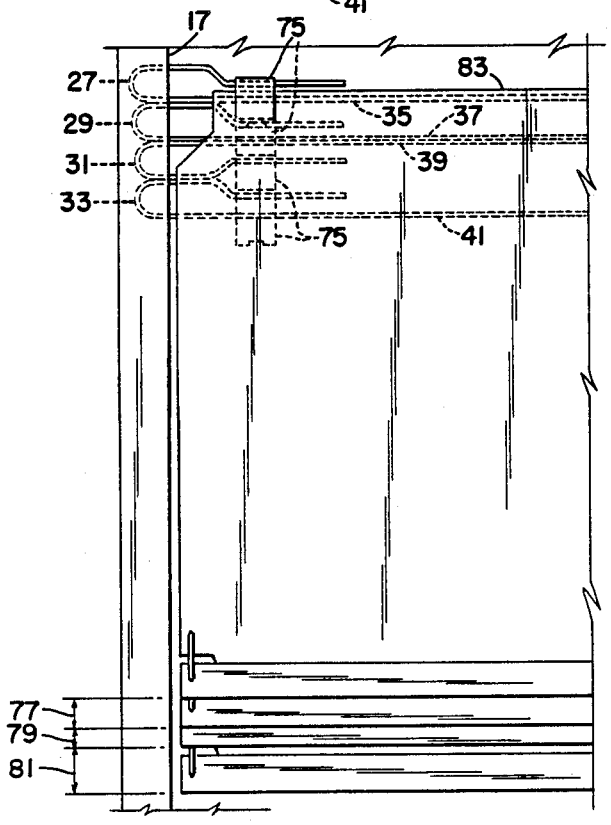
FIG. 3 is a partial plan view of prior art hangers inserted in random fashion to produce varying index visibilities.

Referring to FIG. 3 the hangers 27, 29, 31 and 33 disposed as in FIG. 2 are shown with card holders 83 depending therefrom. The card holders are fastened to the free end portions 59, 61, 63 and 65 of the hangers by conventional hinges 75.

The non-uniform hinge axis spacings A, B and C described in connection with FIG. 2 produce non-uniform visible index sight spaces indicated at 77, 79, and 81. This creates an undesirable condition wherein the index information on certain index cards is overexposed while the information on other index cards is underexposed partially or totally obscured. Thus the sight space 77 is a normal or desired distance whereas the sight space 81 is excessive and the sight space 79 is less than desired. The index card holders are moveable as explained and the condition illustrated in FIG. 2 can readily lead to the virtual disappearance of the sight space of one or more of the pocket cards in the index system.

DESCRIPTION OF THE INVENTION

Figure 4:
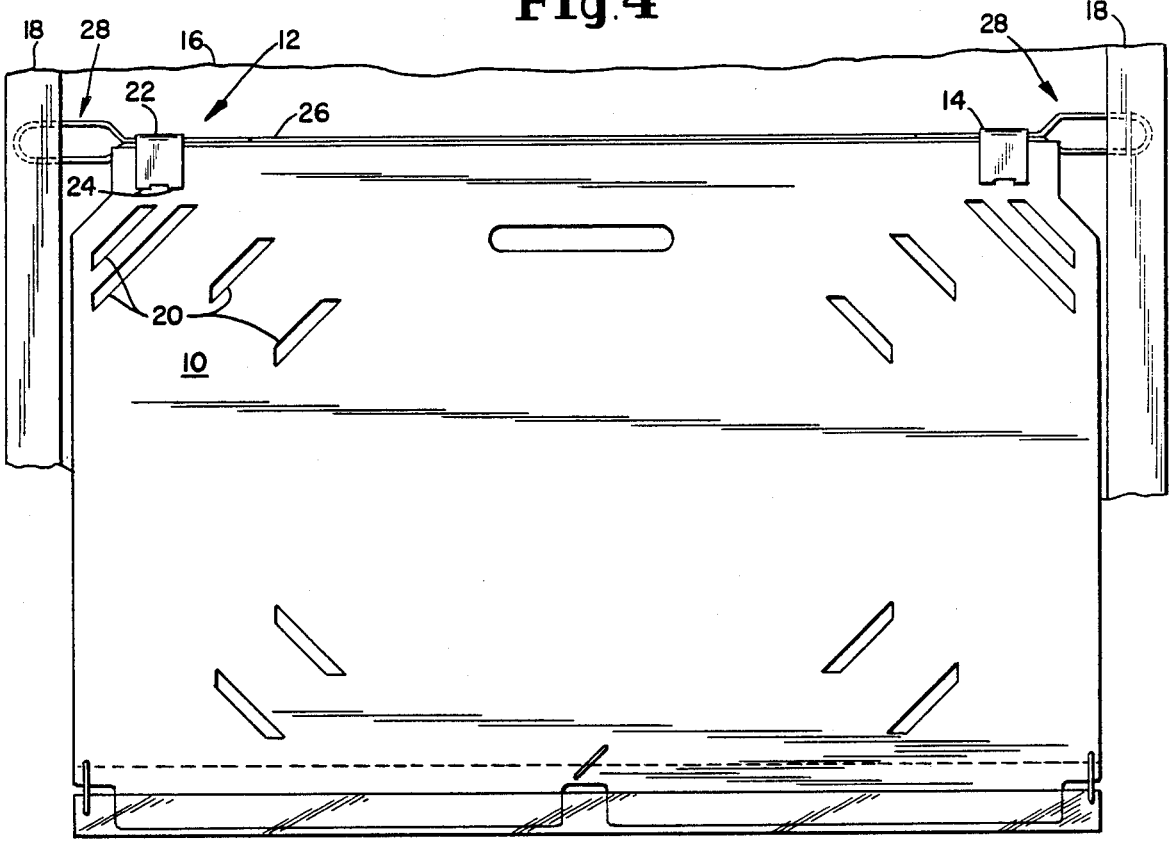
FIG. 4 is a fragmented partial plan view showing a pocket card mounted according to the present invention.

The embodiment of the present invention illustrated in FIG. 4 includes a pocket card 10 mounted on a wire hanger indicated generally at 12 by conventional metal hinges 14. The wire hanger 12 is mounted in a holder, panel or tray 16 by flanges or turn-overs 18.

The pocket card or card holder 10 may have a plurality of card retaining slots or apertures 20 extending diagonally across the holder in the area adjacent each of the four corners. These slots are for the purpose of retaining cards or other information in sheet form and the slots 20 may extend at any desired angle such as about 45° relative to the top of the card holder. Each metal hinge 14 includes a barrel 22 at the top portion thereof for receiving the wire hanger 12. Each hinge also includes a pair of legs or prongs 24 which extend through the card holder 10 and are bent up adjacent the rear surface of the holder in a conventional manner.

Figure 5:
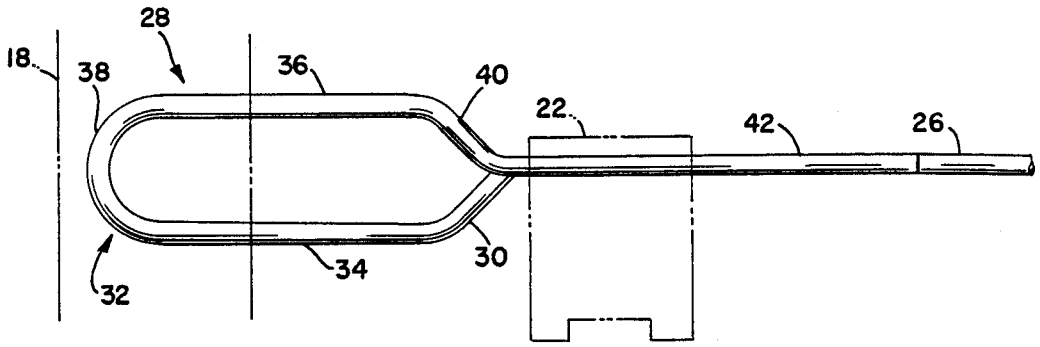
FIG. 5 is a partial plan view of an end of a wire hanger constructed according to the present invention showing a hinge and flange in phantom.
Figure 6:
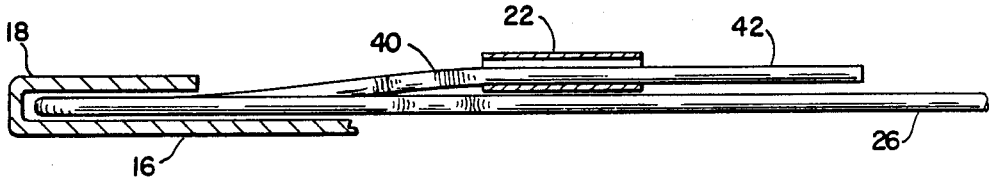
FIG. 6 is a side elevation of the end of a hanger constructed according to the invention showing the hinge and mounting flange in partial section.

The wire hanger 12 comprises a main body 26 which is straight or rectilinear in shape and terminates in reverse bent end portions indicated generally at 28. Referring to FIGS. 5 and 6 there is shown the left end of the hanger 12 of FIG. 4. Referring more particularly to FIG. 5 it is seen that the end of the main body 26 of the wire hanger 12 is bent with respect to the longitudinal axis of the main body to form the generally diagonal extending portion 30. From diagonal portion 30 the end of the wire hanger is reverse bent to form a loop indicated generally at 32.

The loop 32 comprises parallel spaced rectilinear portions or sides 34 and 36 connected by return 38. The rectilinear portions 34 and 36 are generally parallel and disposed substantially equal distances from the axis of the main body 26 of the wire hanger 12 on opposite sides thereof. The upper rectilinear portion 36 as seen in FIG. 5 is downwardly bent to form a diagonal leg indicated at 40. This diagonal leg 40 terminates in a hanger end 42 which overlies the main portion 26 of the hanger 12 as may best be seen in FIG. 6.

The loop 32 comprising rectilinear portions 34 and 36 and return 38 lie generally in the same plane. The diagonal leg 40 is bent upwardly as seen in FIG. 6 so that the end 42 extends parallel to the main body 26 in an overlying and slightly spaced fashion. The barrel 22 of the hinge 14 is mounted on the end 42 of the wire hanger 12. If desired a further hinge may be mounted along side the first on the end 42 of the wire hanger 12.

Referring to FIGS. 5 and 6 it will be seen that the wire hanger of the invention is generally symmetrical in plan view. As a result of the overlying relationship of the hanger ends to its main body portion the hanger does not lie in a single plane. The pivotal axis for the hinges is colinear with the ends 42 of the hanger which overlie the main body 26. When a series of hangers is disposed in parallel relationship in the usual fashion the main portions of the hangers lie substantially in a single plane. According to the invention the ends of the improved hangers lie in a different plane and establish hinge axes for the hinges in a second plane which is spaced from the plane of the main body portions of the hangers.

This arrangement provides free pivotal movement for the hinges regardless of whether the hanger 12 is mounted in the disposition shown in FIG. 4 or whether the hanger is reversed 180° from that position. In either event the axes of the end portions of the hangers which form the hinge axes lie substantially in a plane which is spaced above the plane of the main body portions of the hangers. The construction of the invention eliminates the above described problem encountered with erroneous mounting of conventional wire hangers in the holder or tray. While it is theoretically conceivable that one might attempt to mount the wire hanger with the ends 42 in a downward disposition as viewed in FIG. 6 it will be apparent that this is not possible as a practical matter. The invention thus virtually precludes improper mounting in a simple, economical and highly practical manner.

It will be understood that while a single wire hanger and pocket card are illustrated in the drawings herein a large multiplicity of such hangers and cards are customarily carried by a single frame or tray of a visible index system. Typical arrangements are illustrated by way of example in the Powell and Hopkins patents described hereinabove and commercial embodiments are presently marketed by Data Visible Corporation, P.O. Box 7767, Charlottesville, Va. 22906–7767 under the trademark "DAKAR."

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What I claim and desire to have secured by Letters Patent of the Unites States is:

1. The combination of a pocket card and a hanger for removably affixing said hanger to a pocket card support structure, said pocket card having hinges at opposite ends of one edge thereof and said hanger comprising: a substantially rectilinear main body portion extending along said one edge of said pocket card and an integral loop portion at each end of said main body portion, each said loop portion having a pair of spaced, substantially parallel sides with longitudinal axes which: lie in the same plane as the longitudinal axis of said main body portion, extend substantially parallel to the longitudinal axis of said main body portion, and are symmetrically disposed on opposite sides of said longitudinal axis of said main body portion, one of said sides of each said loop portion having a free end portion which extends along and substantially parallel to said axis of said main body portion and lies to one side of said main body portion, the longitudinal axes of the main body portion and the free end portions of said hanger being contained in a plane disposed at a right angle to the plane containing the longitudinal axes of said main body portion and the parallel sides of said loop portions, and said free end portions of the hanger extending through said hinges to thereby pivotably secure said pocket card to said hanger.

2. A wire hanger for pivotally supporting a pocket card of a visible index system from a card-supporting structure of that system, said wire hanger having: a substantially rectilinear main body portion and an integral loop portion at each end of said main body portion, said loop portions being adapted to be detachably fixed to said pocket card-supporting structure and each said loop portion having a pair of spaced, substantially parallel sides with longitudinal axes which: lie in the same plane as the longitudinal axis of said main body portion, extend substantially parallel to the longitudinal axis of said main body portion, and are symmetrically disposed on opposite sides of said longitudinal axis of said main body portion, one of said sides of each said loop portion having a free end portion which extends along and substantially parallel to said longitudinal axis of said main body portion, lies to one side of said main body portion, and is adapted to extend through a hinge incorporated in said pocket card to thereby pivotably secure said pocket card to said hanger, the longitudinal axes of the main body portion and the free end portions of said hanger being contained in a plane which is disposed at a right angle to the plane containing the longitudinal axes of said main body portion and the parallel sides of said loop portions.

3. A visible index system which comprises: a plurality of pocket cards, each having hinges at opposite ends of one edge thereof; a pocket card support having inwardly opening recesses extending along the opposite sides thereof; and wire hangers for detachably affixing said pocket cards to said pocket card support, said wire hangers being associated with said pocket cards on a one-to-one basis and each wire hanger having: a substantially rectilinear main body portion extending along said one edge of the associated pocket card and an integral loop portion at each end of said main body portion, said loop portions being installed in the inwardly directed recesses at the opposite sides of said pocket card support to thereby detachably secure said hanger to said support and each said loop portion having a pair of spaced, substantially parallel sides with longitudinal axes which: lie in the same plane as the longitudinal axis of said main body portion, extend substantially parallel to the longitudinal axis of said main body portion, and are symmetrically disposed on opposite sides of said longitudinal axis of said main body portion, one of said sides of each said loop portion having a free end portion which extends along and substantially parallel to said longitudinal axis of said main body portion and lies to one side of said main body portion, the longitudinal axes of the main body portion and the free end portions of said hanger being contained in a plane disposed at a right angle to the plane containing the longitudinal axes of said main body portion and the parallel sides of said loop portions, and said free portions of the hanger extending through said hinges to thereby pivotably secure said associated pocket card to said hanger.

* * * * *